US007669698B2

(12) United States Patent
Jahkonen

(10) Patent No.: US 7,669,698 B2
(45) Date of Patent: Mar. 2, 2010

(54) METHOD AND SYSTEM FOR DETERMINING POSITION INFORMATION OF AN ELEVATOR

(75) Inventor: Pekka Jahkonen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/332,805

(22) Filed: Dec. 11, 2008

(65) Prior Publication Data

US 2009/0166134 A1 Jul. 2, 2009

Related U.S. Application Data

(63) Continuation of application No. PCT/FI2007/000159, filed on Jun. 6, 2007.

(30) Foreign Application Priority Data

Jun. 13, 2006 (FI) ..... 20060588

(51) Int. Cl.
*B66B 3/00* (2006.01)

(52) U.S. Cl. ..... 187/394; 187/247

(58) Field of Classification Search ..... 187/391–394, 187/380–388, 247

See application file for complete search history.

(56) References Cited

U.S. PATENT DOCUMENTS 4,083,430 A 4/1978 Gingrich
4,494,628 A 1/1985 Uherek et al.
4,750,592 A 6/1988 Watt
4,798,267 A 1/1989 Foster et al.
5,509,505 A * 4/1996 Steger et al. ..... 187/394
5,798,490 A * 8/1998 Vairio et al. ..... 187/394
5,844,180 A * 12/1998 Liebetrau et al. ..... 187/394
7,077,244 B2 * 7/2006 Oh et al. ..... 187/394
7,441,631 B2 * 10/2008 Oh et al. ..... 187/394
2002/0043433 A1 4/2002 Tanino et al.

FOREIGN PATENT DOCUMENTS

EP 0 382 933 A2 8/1990
FI 118382 B 10/2007

* cited by examiner

*Primary Examiner*—Jonathan Salata
(74) *Attorney, Agent, or Firm*—Birch, Stewart, Kolasch & Birch, LLP

(57) ABSTRACT

Elevator system and a method for determining the position information of an elevator car is disclosed. The elevator system includes at least one elevator car, which is fitted to move in an elevator shaft, a control unit for controlling the motions of the elevator car according to calls conveyed to the control unit, and at least one landing call unit fitted in connection with a landing. The landing call unit includes a feature for giving a call and for sending a call to the control unit and a data transfer channel between the landing call unit and the control unit. At least one identifier is fitted in connection with the elevator car. The landing call unit also includes at least one reader fitted to detect the identifier of the elevator car when this is situated in the proximity of the reader.

19 Claims, 4 Drawing Sheets

METHOD AND SYSTEM FOR DETERMINING POSITION INFORMATION OF AN ELEVATOR

FIELD OF THE INVENTION

Figure 1:
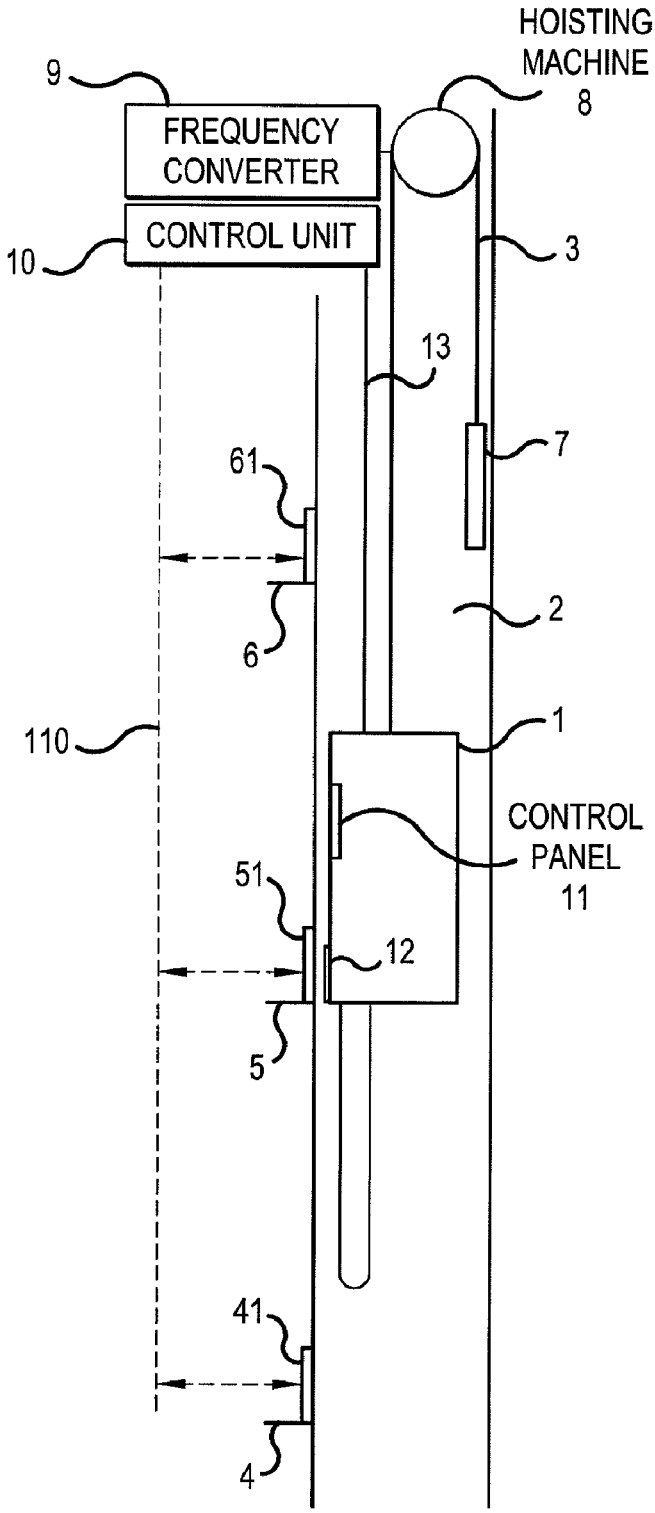

The present invention relates to an elevator system according to claim 1 and a method for determining the position information of the elevator car according to claim 17.

PRIOR ART

Information about the position of the elevator car in the elevator shaft at each moment in time is an important factor in directing an elevator car to the floor specified by the calls given by a customer or otherwise by the elevator control. To ensure the safety of passengers the elevator car must stop at the desired floor as precisely as possible so that the floor of the elevator car and the floor of the landing are at the same height, and when the elevator car is outside the landing zones the doors of the car and of the landing must be closed. It is also desirable to convey information about the floor at which the elevator car is positioned at any time to passengers waiting on the landings.

The position of the elevator car in the elevator shaft can be determined e.g. by connecting a speed sensor to the motor of the elevator and by calculating the position of the elevator car by means of the number or frequency of pulses received that are comparable to the speed. The pulse sequence comparable to the speed of the elevator car can also be produced e.g. with the solution presented in publication FI76768, in which the meter pulses needed for floor distribution are achieved with an acceleration sensor disposed in the elevator car, the signal produced by which is integrated into a voltage expressing the speed of the elevator, which is further converted into a pulse sequence, the frequency of which depends on the speed of the elevator car. When the position of the elevator car is determined by means of a sensor connected to the motor, the position information obtained is linked to the motions of the motor, and any rope slipping occurring, e.g. in conjunction with an emergency stop, remains unaccounted for in determining the position of the elevator car. An error in determining the relative positions of the elevator car and the landing is also caused by, among other things, a change in the positions of landings as a consequence of subsidence and/or extension of the building.

Errors occurring in determining the position can be rectified e.g. by placing magnets in connection with each landing and by placing magnetic switches in connection with the elevator car, by means of which the arrival of the elevator car at the landing is detected.

Typically information about elevator landings and their distances from a known reference point, such as with respect to the shaft limit switches, is stored in the control unit of the elevator system. By monitoring the distance traveled by the elevator car with respect to a known reference point it is possible to determine at which point of the elevator shaft the elevator car is situated, and the position information can be rectified by means of synchronization switches at the landing zones. If the landing zones are marked with a magnet that indicates the landing zone, and the position information of the elevator car is lost as a consequence of a malfunction, typically the elevator car must drive to a reference point at the top end or bottom end of the shaft to acquire the position information again.

Prior art also includes solutions in which the landing zones are marked with identifiers that convey floor number data, for which floor information can be arranged e.g. by means of a barcode, in which floor number data can be read from the elevator car manually. A drawback with this arrangement is, among others, the costs incurred in reading the identification and conveying the information about the elevator car to the control system of the elevator.

In addition to the aforementioned drawbacks, prior art solutions also contain the problem that when the elevator position information is received or rectified with switches positioned on the elevator car, the information must be conveyed from the elevator car to the control system e.g. along the trailing cables. Separate conductors for this purpose are needed in the trailing cables, which increases the price of the trailing cable. The switches that must be disposed in connection with the elevator car to read or rectify the position information are components that are sensitive to damage and when located on the roof or on the base of the elevator car they take up space in the elevator shaft.

Arrangements have also been disclosed with which the position of the elevator car can be determined absolutely in the elevator shaft without switches located in the vicinity of the landing zones, e.g. by means of a coded tape connected to the guide rail of the elevator or electromagnetic waves. The drawbacks of these solutions, in addition to high costs, are that the position information is not tied to the floor landings, the position of which can change over time as a consequence of subsidence and/or extension of the building.

Publication U.S. Pat. No. 4,083,430 presents detection of the location of an elevator car from the change of the magnetic field in sensors installed at landings caused by a vertically elongated strip fixed to the car and the combination of these in the elevator control equipment, in which landing calls can also be processed.

Publication U.S. Pat. No. 4,494,628 presents an identifier composed of reflective strips in the elevator shaft at the location of floors and the detection of this by a reader from the elevator car.

Publication EP0382933 presents determination of the position of an elevator car with identifiers and optical sensors disposed at the floors.

Publication US2002/0043433 presents a position determination appliance connected to the elevator control panel as well as landing call panels and car drive panels.

PURPOSE OF THE INVENTION

The purpose of this invention is to disclose a new type of method for determining information about the position of an elevator in the elevator shaft and an elevator system, in which the position of the elevator car and of the landing in relation to each other can be determined inexpensively and reliably.

Characteristic Features of the Invention

The elevator system of the invention is characterized by what is disclosed in the characterization part of claim 1, and the method of the invention for determining the position of the elevator car is characterized by what is disclosed in claim 17. Other embodiments of the invention are characterized by what is disclosed in the other claims. Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts.

The elevator system according to the invention comprises at least one elevator car, which is fitted to move in an elevator shaft, a control unit for controlling the motions of the elevator car according to calls conveyed to the control unit, and at least one landing call unit fitted in connection with a landing, which landing call unit comprises means for giving a call and for sending a call to the control unit, and a data transfer channel between the landing call unit and the control unit. According to the invention at least one identifier is fitted in connection with the elevator car, and the landing call unit comprises at least one reader, which reader is fitted to detect the identifier of the elevator car when this is situated in the proximity of the reader. The landing call unit can comprise means for storing floor information, and it can be fitted to convey data to the control unit when the reader has detected the identifier of the elevator car. The information conveyed by the landing call unit can be e.g. floor information. The readers can be e.g. reed switches and the identifiers can be magnets.

According to one embodiment of the invention the landing call unit comprises at least one second reader, which second reader is fitted to detect the identifier of the elevator car when this is situated in the proximity of the reader. The landing call unit can be fitted to convey information to the control unit when at least one second reader has detected the identifier of the elevator car. In one embodiment of the invention the landing call unit is fitted to convey information to the control unit with two means that are independent of each other.

In one elevator system according to the invention the landing call unit comprises means for conveying the floor information of the elevator to the users, and the landing call unit can further comprise means for conveying the call registration information of the elevator to the users. The control unit and the landing call units of the elevator can be fitted to communicate between each other via a serial interface, e.g. using DTMF technology. It is also possible that the landing call units are fitted to send a landing call of the elevator and/or the floor information of the elevator to the control unit as repeated separate transmission series, and if the landing call units are fitted to send a landing call and the floor information of the elevator along the same data transmission channel, to send these preferably as repeated separate transmission series of different lengths to each other.

In one elevator system according to the invention the control unit of the elevator comprises means for determining the computed position information of the elevator car by means of the signal comparable to the speed of the elevator car or to the motor of the elevator, which computed position information can be updated by means of the information conveyed to the control unit by the landing call units.

In the method according to the invention for determining the position information of the elevator car in an elevator system, which elevator system comprises at least one elevator car, which is fitted to move in an elevator shaft, a control unit for controlling the motions of the elevator car according to calls conveyed to the control unit, and at least one landing call unit fitted in connection with a landing, which landing call unit comprises means for giving a call and for sending a call to the control unit, with at least one reader fitted to the landing call unit at least one identifier fitted in connection with the elevator car is detected when this is situated in the proximity of the reader. According to the invention it is possible to further convey information from the landing call unit to the control unit when the reader detects an identifier. The information can be conveyed from the landing call unit to the control unit via two data transfer channels that are independent of each other.

One advantage of the method and of the elevator system according to the invention is, among others, that accurate information about the position of the elevator car in the elevator shaft is obtained with few components in terms of their cost. When prior art landing call units containing floor information are used in elevator systems for obtaining absolute position information for the control unit, the determination of the position of the elevator according to the method and the elevator system are inexpensive and simple to implement. In the elevator system according to the invention it is not necessary to convey information for determining position information, or for correcting it, along the trailing cables to the control system of the elevator, in which case a smaller quantity of trailing cables is needed than in prior art. The elevator system according to the invention is reliable, and in malfunctioning situations the position information of the elevator car can be updated at the nearest landing, in which case the identifiers used in prior art in the top parts and the bottom parts of the elevator shaft for synchronizing the position information are not needed.

PRESENTATION OF FIGURES

Figure 2:
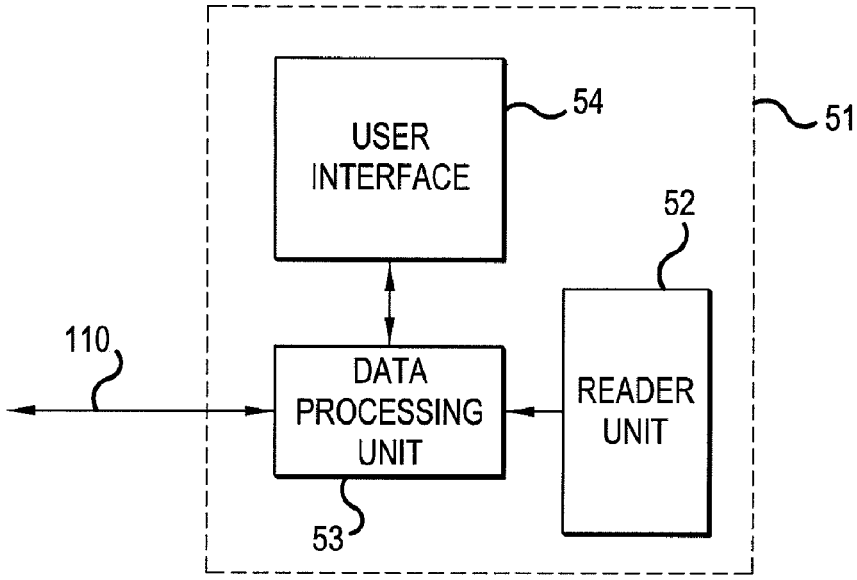
Figure 3:
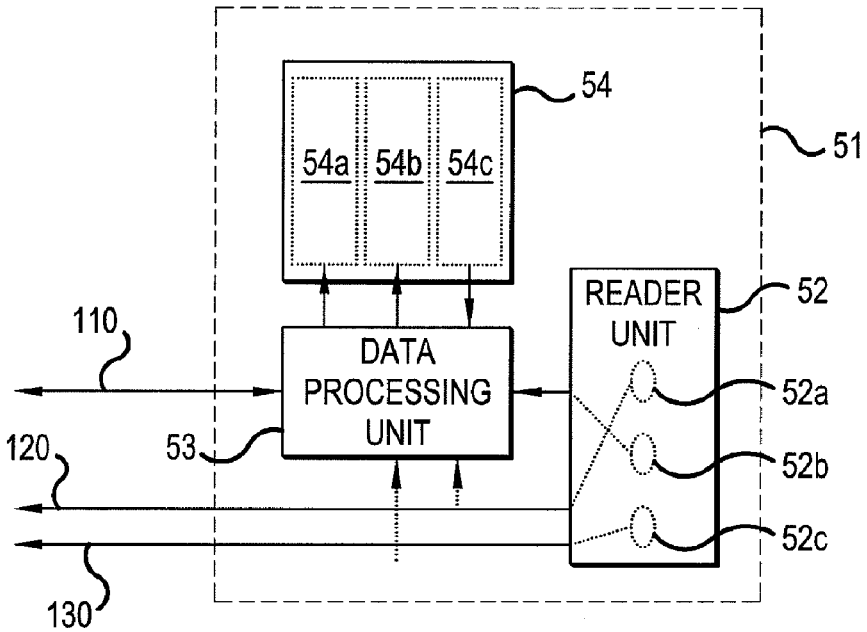
Figure 4:
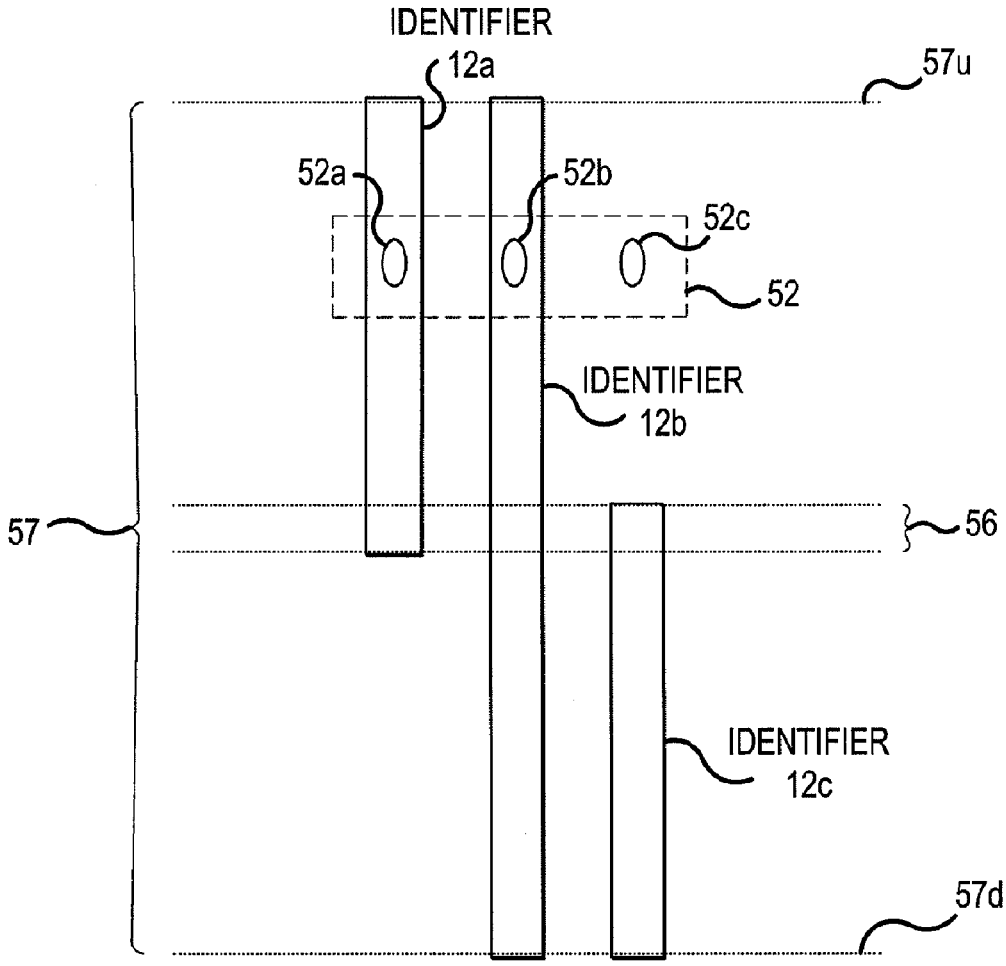
Figure 5:
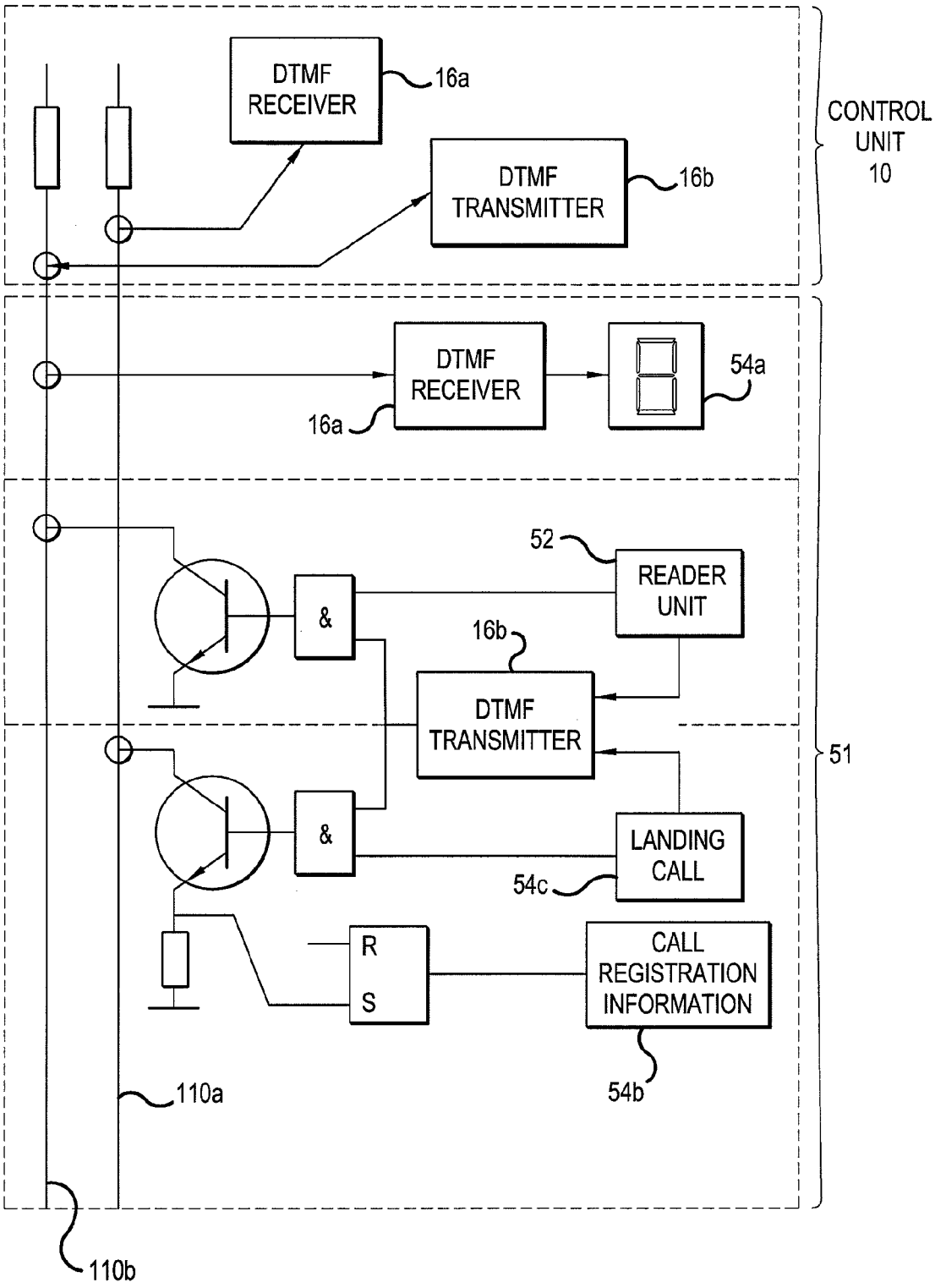

In the following, the invention will be described in more detail by the aid of a few examples of its embodiments with reference to the attached drawings, wherein FIG. 1 presents an elevator system according to the invention FIG. 2 presents a landing call unit according to the invention FIG. 3 presents a second landing call unit according to the invention FIG. 4 illustrates the connection of the reader unit and the identifiers of the invention to each other FIG. 5 presents a block diagram of the operation of a floor counter and call issuing system of the elevator system according to the invention.

EMBODIMENTS

FIG. 1 presents an embodiment of the elevator system according to the invention.

In the elevator system according to the invention the elevator car 1 is moved in the elevator shaft 2 via the hoisting ropes 3 of the elevator between the floors 4, 5 and 6 according to calls given to the system. The elevator system according to FIG. 1 also contains a counterweight 7, but the elevator system according to the invention can also be one without counterweight. The hoisting machine 8 of the elevator comprises a traction sheave and a motor, the electricity supply and control of which is arranged with a frequency converter 9. The elevator system also comprises an elevator control unit 10, which controls the operation of the elevator system according to the floor and landing calls conveyed to it. Landing call units 41, 51 and 61 are arranged for each floor, with which a user can present a call for the elevator to arrive at that floor, and from which calls are conveyed to the control unit 10. In the system according to FIG. 1 data transmission from the landing call units 41, 51 and 61 is arranged with a serial bus cable 110, but the connection can also be arranged with another suitable method, such as with a wireless data transmission link or by arranging separate wiring from each landing call unit to the control unit 10. Further, in one elevator system according to the invention the landing call unit is fitted to convey information to the control unit both via a serial bus and via separate conductors arranged for the purpose of conveying position information. The landing call units 41, 51 and 61 comprise at least a user interface, such as a button, with which the user can give a landing call, and means for sending call information to the control unit 10. The landing call units according to the invention further comprise at least one reader, e.g. a reed switch, with which the position of the elevator car at each specific floor can be detected. When the positioning of the elevator car at the floors 4, 5, 6 is detected in the landing call unit 41, 51, 61, which even in prior art comprises floor information and a data transmission link for conveying landing calls to the control unit, it is possible with the elevator system according to the invention to integrate the landing call appliances and the positioning appliances into one unit and to convey both call information and the position information of the elevator car using the same data transfer means. In this way it is possible to reduce the quantity of data transfer channels, thus achieving considerable cost savings, especially when the needs for data transfer via expensive trailing cables decreases. Further, with the arrangement more accurate information about the position of the elevator car is obtained when the floor information coded into the landing call unit is combined with the information that the elevator car is located in the landing zone.

The structure and operation of the landing call appliances is described in more detail in conjunction with FIG. 2. The user can give commands to the elevator also via the control panel 11 of the elevator car 1, the calls received from which are conveyed to the control unit along the trailing cable 13. The elevator car also comprises one or more identifiers 12, which can be e.g. a magnet, by means of which the reader unit 42, 52, 62 of the landing call appliances 41, 51, 61 detect the positioning of the identifiers of the elevator car in the proximity of the readers.

FIG. 2 illustrates the structure of a landing call unit 41, 51, 61 according to the invention. For the sake of simplicity only the landing call unit 51 is referred to in the numbering and explanation of the figures, but the landing call units 41 and 61 are preferably of similar structure. The landing call unit 51 comprises at least a data processing unit 53, which can comprise e.g. a microchip, a microcontroller or a microprocessor or other suitable means, which comprises at least means for storing floor information and for sending a call to the control unit. The landing call unit further comprises a user interface 54, with which information can be conveyed to the user of the elevator and with which the user of the elevator can give commands to the elevator. The user interface can comprise at least means for giving a landing call of the elevator. e.g. pushbuttons, with which a user can give calls to the elevator, such as 'come here', 'go up' or 'go down'. The user interface can also include a display, with which information about e.g. at which floor the elevator car is positioned at any time can be conveyed to users. It is also possible via the user interface to give a response to the user in respect of the registering of the call, e.g. such that a light illuminates in connection with the call pushbutton when a call has been given with the pushbutton. The functions of the user interface are not however limited to those presented above, but it is possible via the user interface to give many other commands and it is possible to convey other information than the aforementioned with the user interface.

The landing call unit according to the invention also comprises a reader unit 52, which comprises at least one reader for detecting the elevator car based on the identifiers 12 fitted in connection with it. Preferably the reader unit 52 also comprises at least one second reader, in which case at least two readers react to the identifiers 12 connected to the elevator car 1.

The readers 52*a*, 52*b*, 52*c* of the reader unit 52 can be e.g. reed switches, optical or mechanical switches or other suitable sensors, with which it is possible to detect the identifier 12 fitted in connection with the elevator car when it is in the proximity of the reader 52*a*, 52*b*, 52*c*. Since the elevator car is fitted to move in an essentially vertical direction on its path, the identifier and the reader are preferably fitted with respect to each other such that the reader detects the identifier when these are on essentially the same horizontal level as each other. It is also possible, however, to fit the reader to detect the identifier in another way, e.g. such that the reader detects the identifier when it is sufficiently close, e.g. less than 5 cm away from the reader, irrespective of the angle between their respective level and the horizontal plane. The identifiers 12 can be e.g. magnets or other applicable means, which are fitted to produce a change in the switch status in the reader when coming into the proximity of it. It is also possible that information is incorporated in the identifiers 12, e.g. coded into a barcode, which can be read by the reader, in which case numerous different identifiers can be individually identified with one reader.

Information about the height of the elevator shaft, about the number of floors 4, 5, 6, and about their positioning in the elevator shaft has been stored in the control unit of the elevator system of FIG. 1. Information about the position of the elevator car in the elevator shaft at each moment in time is also in the control unit. The information about the positioning of the elevator car is monitored preferably constantly by checking the movements of the elevator car 1, the hoisting roping 3 or the elevator motor 8. The relevant information can be stored e.g. in the read-write memory and it is also possible that the position information is updated in the non-volatile memory such that when the read-write memory is emptied, e.g. as a result of an electrical power cut, the position information is still available. In addition to constant monitoring of the position, the position of the elevator car with respect to the floors is inspected by means of the reader units 52 incorporated in the landing call units 41, 51, 61 and of the identifiers 12 fitted on the elevator car. When the elevator car approaches a floor 4, 5, 6 the reader unit 52 of the landing call unit 41, 51, 61 reacts to the identifier 12 of the elevator car 1 and information about the positioning of the elevator car in the relevant landing zone is conveyed from the landing call unit 41, 51, 61 to the control unit 10. By means of the position information conveyed by the landing call unit 41, 51, 61 it is possible to update the position information that is determined by computation and stored in the control unit 10 such that errors in the position information obtained by computation are corrected. Preferably the calculated position information is corrected always when the elevator car approaches a floor 41, 51, 61 irrespective of whether the elevator car is intended to stop at that floor or to continue its journey past the floor.

In the event of an electricity power cut it is possible that the computed position information stored in the control unit 10 disappears. Since floor information is coded into each landing call unit, which can be conveyed to the control unit, the position of the elevator car in the elevator shaft can be determined after an electricity power cut by driving the elevator car to the nearest floor, and the synchronization means used in prior art at the ends of the elevator shaft are not needed. The functional blocks of the control unit can also be located apart from each other, e.g. such that the calculated information about the position of the elevator car at each moment in time is maintained by a unit situated in connection with the frequency converter 9, and control commands and the position information of the elevator car received from the landing call units are received by a separate traffic control unit comprising a processor, which blocks further exchange information with each other.

FIG. 3 presents a second landing call unit 51 according to the invention, and FIG. 4 illustrates the connection between the readers 52*a*, 52*b*, 52*c* of the reader unit 52 and the identifiers 12*a*, 12*b*. In FIG. 4 the identifiers 12*a*, 12*b* are disposed in connection with the elevator car 1 (not shown in the figure) and the reader unit 52 is fitted in connection with the landing call unit 51 (not shown in the figure) situated on the floor 5 (not shown in the figure). As in FIG. 2, the landing call unit 51 of FIG. 3 comprises a reader unit 52, a data processing unit 53 and a user interface 54. The identifier unit 52 of the landing call unit according to FIG. 3 comprises three readers 52*a*, 52*b*, 52*c*, which are preferably reed switches. The readers 52*a* and 52*c* are connected to the control unit of the elevator via the channels 120 and 130, along which information from the sensors about the positioning of the identifier 12 of the elevator car in the proximity of the reader is conveyed to the control unit. The information received from the readers 52*a* and 52*c* is conveyed also to the data processing unit 53. The reader 52*b* is connected to the data transmission unit 53, which has an onward connection to the control unit 10 via the channel 110, and which is also linked to the user interface 54. The user interface 54 comprises at least means for giving a landing call 54*c*, which can comprise e.g. a button or a pushbutton array, means for conveying floor information 54*a*, e.g. a display screen, and means for conveying call registering information to the user 54*b*, which can comprise e.g. a separate lamp or a lamp integrated into the call button.

The readers 52*a*, 52*b*, 52*c* and the identifiers 12 of the elevator car are located with respect to each other such that as the elevator car approaches the floor 51 the reader 52*a* or 52*c* detects the identifier 12 when the elevator car arrives at the landing zone 57. When the elevator car approaches the landing 5 from above, the reader 52*a* detects by means of the identifier 12*a* the top edge 57*u* of the landing zone 57 and conveys this information along the channel 120 to the control unit; correspondingly, when the elevator car approaches the landing 5 from below, the identifier 12*b* is detected by the reader 52*c* at the bottom the top edge 57*d* of the landing zone, and this information is conveyed to the control unit by the channel 130. The channels 120 and 130 are preferably connected directly to that block of the control unit in which the position information of the elevator car as calculated by computation is stored, in which case the position information can be updated quickly always when the elevator car arrives at the landing zone 57, when it passes the stopping zone 56 and/or when it leaves the landing zone 57. Landing zone here means the floor level 5 and the area above and below it, which can be e.g. a length of 150 mm on both sides of the floor level. In one embodiment of the invention the lengths of the landing zone and of the door area are the same, where door area means the area in which the doors of the elevator car are allowed to be open. It is also possible that opening of the doors in this area can be started before the arrival of the elevator car at the floor level.

With the reader 52*b* the arrival of the elevator car at the landing zone 57 is likewise detected. The type of landing call unit and identifiers described in FIGS. 3 and 4 could also be implemented according to the invention without the reader 52*b* and the identifier 12*b*. The safety level of the elevator system is, however, better when information from the reader 52*b* is conveyed to the data processing unit and onwards to the control unit 10, in which case information about the positioning of the elevator car in the landing zone is conveyed to the control unit through two data transfer channels that are independent of each other.

When both the readers 52*a* and 52*c* detect the identifier 12*a*, 12*c* simultaneously, it is known that the elevator car has arrived in the stopping zone 56, i.e. in the area in which the floors of the elevator car and of the floor landing are facing each other within the scope of tolerance defined for the stopping zone. The stopping area 56 can be e.g. of 0.5 . . . 5 cm in length, and it is preferably set such that exactly in the middle of the stopping zone the floors of the elevator car and of the floor landing are facing each other. It is possible that as the loading of the elevator changes the position of the elevator car changes owing to, among other things, stretching of the ropes such that the elevator is forced out of the stopping zone, and the elevator control can comprise a re-leveling setting, with which the elevator car can in these situations be returned to the stopping area.

The landing call unit according to the invention can also comprise more readers than three, and there can be fewer readers, e.g. one or two. Further, there may be one or more identifiers on the elevator car. In this way more points can be set e.g. at which the speed of the elevator car can start to be decelerated as it arrives at a floor level from above or from below, in addition to the landing zones and stopping zones.

It is further possible that a number of readers are disposed in parallel in the landing call unit such that when the identifier of the elevator car arrives at a certain point comprising a number of readers the positioning of the elevator car at that point is detected by a number of readers that are independent of each other. It is further possible that identifiers are connected in conjunction with the landing call unit and reader units on the elevator car side for detecting them. In one preferred embodiment of the invention the reader unit 52 of the landing call unit 51 contains four readers and there are two identifiers on the elevator 1, of which readers two detect the first identifier and the two other readers detect the second identifier.

In one preferred embodiment of the invention DTMF, i.e. dual tone multiple frequency, technology is used for conveying information from the data processing unit 53 to the control unit, but also many other serial bus technologies are suited for use in the system according to the invention. It is also possible to convey information from each floor to the control unit via a data transfer channel dedicated to the specific floor. One advantage of DTMF, among others, is that traffic is not sensitive to interference and, unlike in many digital protocols, error checking is not needed. The speed of 100 . . . 200 baud achieved with DTMF for conveying calls and for updating the display screen information of the landings is very adequate, and the DTMF signal is almost immune to random noise. In order for a DTMF network that comprises up to 20-30 nodes to be implemented according to the invention, the DTMF bus is preferably implemented as a fixed impedance. This can be implemented e.g. by using the power sources as a transmitter, which is possible since the elevator car can be located only at one floor at any given moment.

FIG. 5 illustrates with the aid of a block diagram the operation of a floor counter and of a call issuing system of an elevator system according to the invention. These are described by the aid of a simple embodiment, in which the user can give just a "come here" call as a landing call, but the elevator system according to the invention can also comprise landing call functions that are more diversified. In particular, if the data processing unit 53 comprises a microprocessor, it is possible according to the invention to implement a very diversified call- and floor-counter system with different options.

In the solution according to FIG. 5 the landing call unit 51 comprises a DTMF transmitter 16*b* and a DTMF receiver 16*a*. The landing call unit 51 communicates with the control unit 10 via the channel 110*a* and with the control unit 10 as well as with the other landing call units 41, 61 via the channel 110*b*. Of these, the channel 110*a* is used for conveying calls and the channel 110*b* for conveying the position information of the elevator. It is also possible that the position information and the landing calls are transmitted via the same data transfer channel. In one preferred embodiment of the invention information about the arrival of the elevator car at the landing zone 57 is also conveyed to the control unit, for updating the position information, from each landing call unit via its own channel, in which case the approx. 50 ms delay caused by the DTMF transmission does not cause a delay in position determination. Especially in applications in which the elevator is permitted to keep the door open also outside the stopping zone, the floor information must be conveyed to the control unit using two methods that are independently of each other, in which case using the different channels 120 and/or 130 for conveying position information to the control unit is preferred.

The floor counter according to the invention operates as follows. When the elevator car arrives at the landing zone 57, one or more readers of the reader unit 52 detects at least one identifier 12 fitted to the elevator car 1, and the signal conveyed to the DTMF transmitter 16*b* by the reader unit 52 activates transmission of the floor information to the channel 110*b*. All the landing call units 41, 51, 61 connected to the channel 110*b* receive a signal containing floor information with the receivers 16*a*, from which the information is conveyed onwards to the user interfaces 54, especially to the means for conveying floor information to the user 54*a*, which results in the updating of the floor information in the means 54*a*. Typically the means 54*a* are implemented with a numerical display. Floor information is also conveyed to the control unit 10 of the elevator.

When the user gives a landing call with the means 54*c*, typically with a pushbutton, information about the landing call is conveyed along the channel 110*a* to the control unit 10 of the elevator, which further directs the elevator car 1 to arrive at the floor requested by the user. Giving a call also activates the means 54*b*, e.g. a lamp, in which case information that the call has been registered is conveyed to the user. The lamp remains on until the elevator car 1 arrives at the relevant landing zone 57 and the reader unit 52 produces a signal indicating this. It is also possible by means of the landing call unit to produce a sound indicating the arrival of the elevator car at the floor.

Thus in the arrangement according to FIG. 5 the means for conveying call registration information 54*b* is managed locally in the landing call unit 51. It is however possible that call registration information is managed in the control unit 10 according to prior art. It is further possible that the landing call unit 51 comprises means with which a landing call is verified as registered only when driving of the elevator to the relevant floor is permitted and the landing call has been accepted.

According to one embodiment of the invention landing calls are transmitted as repeated separate transmission sequences, e.g. a signal is transmitted as 50 ms sequences such that between each transmission sequence is a time of approx. 100 . . . 200 ms when no transmission occurs. The aforementioned times are given as examples, and sequences of other lengths are also possible. This avoids the failure to register a call resulting from the collision of calls sent simultaneously from numerous landings. The transmission of each call can comprise e.g. 3-5 transmission sequences, but a greater number of transmission sequences than this is possible.

In one embodiment of the invention both the landing calls and the signals indicating the position of the elevator are sent along the same channel. In this case call signals and position signals can be distinguished from each other by using transmission sequences for them that are of different lengths. Landing calls can e.g. be sent in 50 ms sequences and signals indicating the position of the elevator in 100 ms sequences. It is also possible that separate codes for call signals and for position information signals are coded into the transmission unit.

In the elevator system according to the invention the landing call units 41, 51, 61 are situated in connection with the landings 4, 5, 6 of the elevator. The functional parts of the landing call units can also be situated apart from each other. Typically e.g. the call pushbuttons of the elevator are next to the landing doors and the display indicating the position of the elevator car is above the landing doors. The reader unit 52 can be disposed e.g. on the top architrave of the landing doors, on the sill, on the side frames of the landing doors or in another suitable place on the floor landing. In one preferred embodiment of the invention the data processing unit 53 and the reader unit 52 are fitted onto the same circuit board.

The inventive concept also comprises a method for determining the position information of an elevator car in an elevator system, which comprises at least one elevator car, which is fitted to move in an elevator shaft, a control unit for controlling the motions of the elevator car according to landing calls and floor calls conveyed to the control unit, and at least one landing call unit fitted in connection with a landing, which landing call unit comprises means for giving a call and for sending a call to the control unit. According to the invention at least one identifier 12, 12*a*, 12*b* fitted in connection with the elevator car 1 is detected with at least one reader 52*a*, 52*b*, 52*c*, 52*d* fitted to the landing call unit 51 when the identifier 12, 12*a*, 12*b* is situated in the proximity of the reader 52*a*, 52*b*, 52*c*, 52*d*. When the reader 52*a*, 52*b*, 52*c*, 52*d* detects an identifier 12, 12*a*, 12*b*, this information is conveyed from the landing call unit 51 to the control unit 10. In one embodiment of the invention the information from the landing call unit 51 is conveyed to the control unit 10 via two data transfer channels that are independent of each other. In one embodiment of the invention the method further comprises the phase: the position information is conveyed to the landing call units of the floor landings.

The invention is further described by the aid of a few examples of its embodiment. It is obvious to the person skilled in the art that the invention is not limited to the embodiments described above, but that many other applications are possible within the scope of the inventive concept defined by the claims presented below.

The invention claimed is:

1. Elevator system, which comprises at least one elevator car, which is fitted to move in an elevator shaft, a control unit for controlling the motions of the elevator car according to calls conveyed to the control unit, and at least one landing call unit fitted in connection with a landing, which landing call unit comprises means for giving a call and for sending a call to the control unit, and a data transfer channel between the landing call unit and the control unit wherein at least one identifier is fitted in connection with the elevator car, and in that the landing call unit comprises at least one reader, which reader is fitted to detect the identifier of the elevator car when this is situated in the proximity of the reader.

2. Elevator system according to claim 1, wherein the landing call unit is fitted to convey information to the control unit when the reader has detected the identifier of the elevator car.

3. Elevator system according to claim 2, wherein the landing call unit comprises means for storing floor information.

4. Elevator system according to claim 3, wherein the landing call unit is fitted to convey floor information to the control unit.

5. Elevator system according to any of claims 1-4 above, wherein the landing call unit comprises at least one second reader, which second reader is fitted to detect the identifier of the elevator car when this is situated in the proximity of the second reader.

6. Elevator system according to claim 5, wherein the landing call unit is fitted to convey information to the control unit when at least one of the two readers has detected the identifier of the elevator car.

7. Elevator system according to claim 6, wherein the landing call unit is fitted to convey information to the control unit by two means that are independent of each other.

8. Elevator system according to clam 1, wherein the landing call unit comprises means for conveying the floor information of the elevator to users.

9. Elevator system according to claim 1, wherein the landing call unit comprises means for conveying the call registration information of the elevator to users.

10. Elevator system according to claim 1, wherein the control unit of the elevator and the landing call units are fitted to communicate with each other via a serial interface.

11. Elevator system according to claim 10, wherein the control unit of the elevator and the landing call units are fitted to communicate with each other using DTMF technology.

12. Elevator system according to claim 10, wherein the landing call units are fitting to send a landing call of the elevator to the control unit as repeated separate transmission sequences.

13. Elevator system according to claim 10, wherein the landing call units are fitted to send the floor information of the elevator to the control unit as repeated separate transmission sequences.

14. Elevator system according to 13, wherein the landing call units are fitted to send a landing call and the floor information of the elevator along the same data transfer channel as repeated separate transmission sequences of different lengths to each other.

15. Elevator system according to claim 1, wherein the control unit of the elevator comprises means for determining the computed position information of the elevator car by means of the signal comparable to the speed of the elevator car or to the motor of the elevator, which computed position information can be updated by means of the information conveyed to the control unit by the landing call units.

16. Elevator system according to claim 1, wherein the readers are reed switches and the identifiers are magnets.

17. Method for determining the position information of an elevator car in an elevator system, wherein the elevator system comprises at least one elevator car, which is fitted to move in an elevator shaft, a control unit for controlling the motions of the elevator car according to calls conveyed to the control unit, and at least one landing call unit fitted in connection with a landing, which landing call unit comprises means for giving a call and for sending a call to the control unit, and wherein at least one identifier fitted in connection with the elevator car is detected with at least one reader fitted to the landing call unit when the identifier is situated in the proximity of the reader.

18. Method according to claim 17 wherein when the reader detects an identifier this information is conveyed from the landing call unit to the control unit.

19. Method according to claim 18 wherein information is conveyed from the landing call unit to the control unit through two data transfer channels that are independent of each other.

* * * * *